United States Patent [19]

Peters

[11] Patent Number: 4,530,377

[45] Date of Patent: Jul. 23, 1985

[54] BLOCK VALVE

[75] Inventor: Clifford M. Peters, Longview, Tex.

[73] Assignee: Joy Manufacturing Company, Pittsburgh, Pa.

[21] Appl. No.: 521,486

[22] Filed: Aug. 8, 1983

[51] Int. Cl.[3] ..... F16K 31/122

[52] U.S. Cl. ..... 137/637.2; 137/625.66; 137/596.15; 137/596.18; 92/66

[58] Field of Search ..... 137/625.48, 625.66, 137/625.67, 625.68, 625.69, 637.2, 596.15, 596.18, 488, 458, 489.5; 91/443; 92/66; 251/29, 63.5, 63.6, 25, 324, 28

[56] References Cited

U.S. PATENT DOCUMENTS

| | | | |
|---|---|---|---|
| 3,716,074 | 2/1973 | Peters | 137/596.18 |
| 3,895,651 | 7/1975 | Okada et al. | 137/637.2 |
| 4,074,702 | 2/1978 | Lewis | 137/625.66 |
| 4,147,179 | 4/1979 | Miura | 91/443 |
| 4,209,040 | 6/1980 | Peters | 137/625.68 |
| 4,304,251 | 12/1981 | Schadel et al. | 137/637.2 |
| 4,320,779 | 3/1982 | Peters | 137/625.66 |

FOREIGN PATENT DOCUMENTS

| | | | |
|---|---|---|---|
| 1214963 | 4/1966 | Fed. Rep. of Germany | 137/625.66 |

*Primary Examiner*—George L. Walton
*Attorney, Agent, or Firm*—Marvin J. Marnock

[57] ABSTRACT

A block valve (10) for selectively establishing and selectively blocking communication between a pressurized fluid supply (30), a fluid actuated device (DHSV) and a reservoir (35). The valve comprises a valve body (41, 42) with an inlet (81), an outlet (82) and a bleed port (83) and first and second piston-type plunger elements (61, 71) slidably mounted in piston chambers (51, 52) formed in the bore (43, 45) of the valve body. The second plunger element (71) is slidably mounted on the first plunger element (61) in sleeved relation therewith. Both plunger elements (61, 71) are continuously urged by springs (66, 75), respectively, to a first operating position wherein communication between the ports (81, 82, 83) is blocked by seal means (94, 95, 96) and blocking means (64) mounted on the plunger elements. Ports (49, 56) in the valve body are connected to a pilot pressure supply (12) whereby the plunger elements (61, 71) are simultaneously movable to second operating positions upon application of pilot pressure to the plunger elements. An annular chamber (91) formed by a reduction in diameter of the second plunger element is placed in communication between the inlet and outlet ports (81, 82) to establish communication therebetween and the seal means (94, 95, 96) are disposed so that communication is blocked between each of these ports and the bleed port (83). Upon interruption of the pilot supply (12), the pressurized pilot fluid is removed from the plunger elements but is removed from the plunger element (61) through a fluid delay circuit (98, 99) whereby the second plunger element (71) is returnable to its first operating position before the first plunger element (61) reaches its first operating position thus blocking communication between the inlet and outlet ports (81, 82) while opening communication between the outlet port (82) and bleed port (83) for a limited period. When the valve (10) is connected in a safety system to control the flow line (84) to a fluid actuator for a DHSV, the valve will respond to a shut-down signal from the safety system to permit the downhole actuator to completely bleed its pressure and allow the DHSV to completely close in this limited time period prior to establishing a positive block in the control line between the DHSV and the safety system.

3 Claims, 3 Drawing Figures

BLOCK VALVE

BACKGROUND OF THE INVENTION

This invention relates to valves, and more particularly to a block valve for use in a hydraulic control circuit for the operation of a downhole safety valve.

In the course of operation of an oil or gas well, it is sometimes desirable and necessary to provide a shut-off capability for permitting the conduct of maintenance operations or for preventing leakage of fuel to the outside environment in the event of an accident. A device which is commonly employed to provide this capability is a surface controlled subsurface safety valve otherwise known as a downhole safety valve (DHSV) which is installed in the production tubing of the well at a specified depth below the wellhead. Such valves are of the "fail-close" design and are customarily operated by a hydraulic actuator located in the well and controlled by a safety controls system located at the surface.

The safety system which is adapted to respond to an excessive or deficient well flow pressure to close the DHSV and shut-off the flow of well fluids from the well, typically includes shut-off relay valves in the control line which, if a leak should occur, will shut-off the supply of pressurized fluid to the downhole actuator and permit the DHSV to close. It is important, however, in shutting off the supply of pressurized fluid to the actuator that the system will permit a sufficient bleeding of the pressurized fluid from the actuator so that the DHSV does not remain open or partially open. Accordingly, the relay valves must not shut-off the control line supply to the downhole actuator until an appropriate time delay so as to permit the actuator for the DHSV to bleed its pressure into a discharge reservoir during the delay. In addition, after the DHSV is closed, the shut-off valves must completely block communication between the DHSV actuator and the reservoir otherwise an equipment failure, such as a packing failure in the DHSV, might cause the well to bleed back into the discharge reservoir with potentially disastrous results.

The use of a fluid controlled delay circuit in controlling the flow of pressurized fluid from a downhole actuator is described in U.S. Pat. No. 4,215,746 and a hydraulic circuit for opening and closing a downhole safety valve which utilizes block valves controlled to allow complete closure of an associated DHSV is disclosed in U.S. Pat. No. 4,193,449. However, the block valves in these systems require many components and considerable piping with attendant disadvantages of reduced reliability, high manufacturing costs, and large space requirements.

It is an object therefore to provide a new and improved block valve for use in a hydraulic system for controlling a DHSV which will provide for a positive block in the control line from the DHSV to the surface system and permit enhanced reliability with a fewer number of system components.

It is another object to provide a block valve having an inlet port, an outlet port and a bleed port and a pair of independently operable valve plunger elements, each of which is movable in response to a pressurized pilot fluid supply for controlling communication between said ports whereby the valve elements are adapted to be moved simultaneously to second operating positions to effect communication between the inlet and outlet ports while blocking communication between these ports and the bleed port and upon removal of pilot fluid pressure to be returned to first operating positions in sequence to shut-off fluid communication between the inlet port and the outlet port and establish communication of the outlet port with the bleed port for a limited period of time prior to blocking of fluid communication between all of said ports by the valve elements.

SUMMARY OF THE INVENTION

The invention is a valve device for controlling fluid communication between a pressurized fluid supply, a fluid actuator device and a reservoir. The valve comprises a valve body with inlet, outlet, and bleed ports and first and second piston-type plunger elements slidably mounted in an axial bore of the valve body. The second plunger element is slidably mounted on the first plunger element in sleeved relation therewith. Both plunger elements are continuously urged by first and second spring means, respectively, to a first operating position wherein communication between the ports is blocked by seal means mounted on the plunger elements. Fluid inlet port means are provided in the valve body which are adapted for connection with a pilot pressure supply whereby the plunger elements are simultaneously movable to second operating positions upon application of pilot pressure to the plunger elements. An annular chamber formed by a reduction in diameter of the second plunger element is placed in communication between the inlet and outlet ports to establish communication therebetween and the seal means are disposed so that communication is blocked between each of these ports and the bleed ports. Upon interruption of the pilot supply, the pressurized pilot fluid is adapted to be removed from the plunger elements through a fluid delay circuit whereby the second plunger element is returnable to its first operating position before the first plunger element reaches its first operating position thus blocking communication between the inlet and outlet ports while opening communication between the outlet and bleed ports for a limited period. The period is measured by the delay in return of the first plunger element to its first operating position. When the valve is connected to control the flowline to a fluid actuator for a DHSV, an interruption in the pilot pressure supply will permit the downhole actuator to bleed its pressure to a degree sufficient for the DHSV to completely close.

Figure 1:
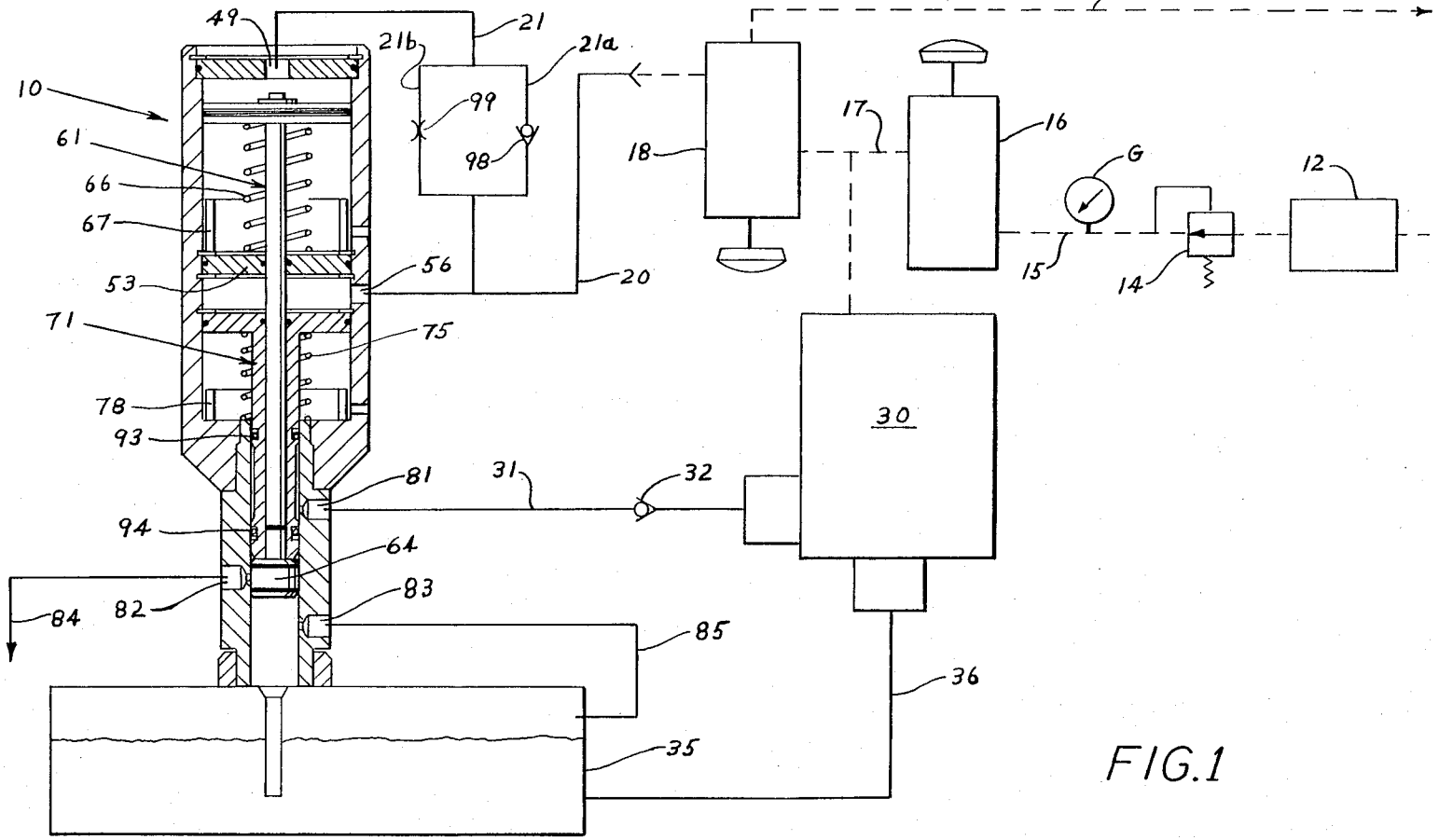
FIG. 1 is a diagrammatic view of a fluid controlled safety system which includes a pilot operated block valve of the invention enlarged for purposes of explanation, and showing the valve in the condition wherein its inlet port which is adapted for connection to a fluid pressure supply is blocked from communication with the outlet port of the valve and both such ports are blocked from communication with a bleed port.

Referring more particularly to the drawings, there is shown in FIG. 1, a portion of a shut-in safety system which utilizes the block valve 10 of this invention. Such safety systems are located at the surface and are operational to effect the remote control of a downhole safety valve installed at a specified depth below the ground surface within the well tubing. Such safety systems are adapted to respond to an unsafe condition as, for example, the detection of a flowline pressure above or below a predetermined acceptable range to shut off the flow of fluids from the well. The DHSV is conventionally of the "fail-close" type which is maintained open by application of fluid pressure to an actuator for the DHSV and is closed by a mechanical spring upon the relieving of fluid pressure from the actuator. Safety systems of this general type are disclosed in U.S. Pat. Nos. 4,074,702; 4,132,383; 4,193,449; 4,209,040; and 4,215,746.

The safety system of FIG. 1 includes a first source 12 of pressurized pilot fluid, such as pressurized air or nitrogen, which is connected through a pressure regulator 14, conduit 15 with pressure gauge G, an emergency shutdown (ESD) valve 16, and conduit 17 with a pilot relay valve 18. The ESD valve 16 is a normally open, one-way valve of conventional type and the relay valve 18 is preferably of the type disclosed in U.S. Pat. No. 3,943,974 or 4,074,702. The operation of the relay valve 18 is controlled by a second pilot pressure which is communicated to the valve 18 by a conduit 19. The conduit 19 is connected to a pair of high-low flowline sensors (not shown) which are monitoring pressure conditions in a production flowline. The sensors are adapted to communicate the second fluid pilot pressure to the relay valve 18 when the pressure sensors sense the flowline to be in the acceptable pressure range and to interrupt this communication when the flowline pressure is outside the acceptable range. An operational arrangement of such pressure sensors is shown in U.S. Pat. No. 4,074,702.

The communication of pilot pressure from the pressure sensors to the relay 18 by means of the conduit 19 places the relay 18 in the open condition whereby pressurized pneumatic fluid from the fluid source 12 can be passed through the relay 18 to the block valve 10 by means of the conduit 20 which connects relay 18 and block valve 10. This pneumatic fluid provides a pilot pressure, the presence or absence of which is used to control the block valve 10 in a manner as will hereinafter be described.

As shown in FIG. 1, a source of hydraulic fluid pressure is provided by a pump 30 which is communicated to the block valve 10 by means of a conduit 31. A check valve 32 in the conduit 31 insures only single directional flow through conduit 31. The pump 30 is an air driven hydraulic pump, such as a Haskel air driven hydraulic pump, available from the Haskel Engineering Co., Burbank, California. The pump 30 receives its pressurized air from the pilot supply 12 by means of the conduit 19 which connects with the conduit 17. The supply of hydraulic fluid for the pump 30 is a reservoir 35 to which the imput of pump 30 is connected by a conduit 36.

The block valve 10, which is shown in vertical section in FIG. 1, comprises a housing formed of a cylindrical upper body section 41 and a lower body section 42. The body section 41 has a longitudinal axial bore 43 extending therethrough with a reduced diameter bore section **43*a* at one end thereof which is provided with internal screw threads 44 for receiving and engaging a threaded end of the lower body section 42. The lower body section 42 is also provided with a central longitudinal bore 45 of smaller diameter than the bore 43** but disposed in coaxial alignment therewith.

The other end of the upper body section 41 is provided with a closure cap 46 in the form of a circular disk element which is seated on an annular shoulder 47 provided by an enlargement of the axial bore 43 and retained in place by a snap ring 48. The closure member 46 is provided with a central opening 49 with internal threads for accommodating connection with a conduit 21 which connects with conduit 20 through a fluid delay circuit.

The valve bore 43 is divided into upper and lower piston chambers 51 and 52, by a transverse divider member 53 provided intermediate the ends of the bore 43 and retained in position by upper and lower snap rings 54, 55. A port 56 is provided through the wall of the housing section 41 into the piston chamber 52 just adjacent the divider member 53. The opening 49 in the closing member 46 and the port 56 provide pilot inlet ports to the piston chamber 51, 52, respectively.

Figure 2:
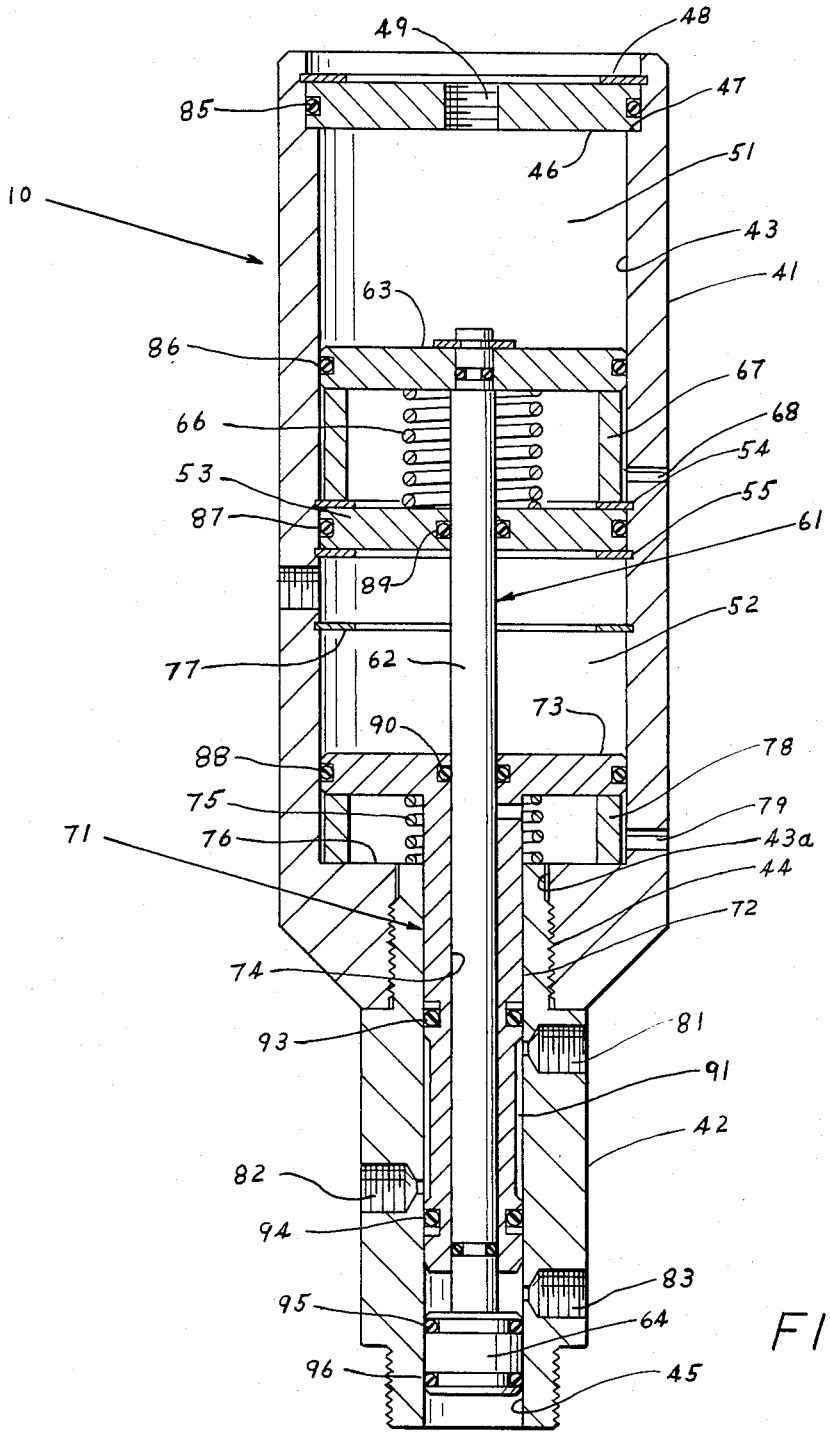
FIG. 2 is a vertical section of the block valve of FIG. 1, showing the valve as energized by a pilot pressure to the open condition wherein the inlet port of the valve is placed in fluid communication with the outlet port of the valve.

A first slidable plunger element 61 which includes a piston rod portion 62 and a piston 63 at one end of the rod is positioned within the bore 43 for sliding movement between a first position, illustrated in FIG. 1 and a second position, illustrated in FIG. 2. The piston 63 is disposed within the upper piston chamber 51 and the piston rod 62 extends into the axial bore 45 in the lower body section 42. The lower end of the piston rod 62 is enlarged to provide a blocking portion 64 of a diameter conforming substantially to that of the bore 45 but slightly smaller so as to be slidably movable therein. The piston 63 is continually biased to the position shown in FIG. 1 by means of a coiled spring 66 disposed in sleeved relation about the piston rod 62 with one end of the spring engaging the underside of piston 63 and the other end abutting the transverse divider member 53. An annular member 67 which is seated on the snap ring 54 within the piston chamber 51 serves as a stop to limit the movement of the piston 63 as urged by the spring 66 to its second operating position shown in FIG. 2. A small vent opening 68 is provided through the wall of upper valve body section 41 adjacent the annular stop ring 67 to facilitate piston movement in the chamber 51.

The block valve 10 also includes a second slidable plunger element 71 which is provided with a piston rod portion 72, a piston 73 at one end of the rod 72, and a longitudinal axial bore 74 extending through the length of the plunger element 71. The plunger element 71 is disposed in sleeved relationship about the piston rod 62 of the first plunger element 61 and intermediate the blocking portion 64 and piston 63 of the first plunger element. The piston 73 is disposed within the lower piston chamber 52 and its piston rod portion 72 is slidably received in the axial bore 45 of valve body section 42. The piston 73 is continually biased to a first operating position as shown in FIG. 1, by means of a coiled spring 75 disposed coaxially in sleeved relationship with the piston rod 72, with one end abutting the underside of piston 73 and its other end abutting annular shoulder 76 defining one end of the axial bore 43.

As snap ring 77 secured in an annular groove formed in the wall of bore 43 adjacent the pilot port 56 limits the upward movement of the second plunger element 71 as urged by the spring 75 to its first operating position just below pilot port 56. An annular member 78 which is seated on and secured to the shoulder 76 within the piston chamber 52 serves as a stop to piston movement when the piston 73 is urged against the spring 75 to its second operating position as shown in FIG. 2. A small vent opening 79 is provided through the wall of the upper valve body section 41 adjacent the annular stop ring 78 to facilitate piston movement in the chamber 52.

In addition to the pilot ports 49 and 56, the valve 10 is provided in its lower body section 42 with a fluid inlet port 81, a fluid outlet port 82, and a bleed port 83, each of which opens to the axial bore section 45. The walls of the ports 81, 82, 83 are threaded for accommodating connection of conduits therewith. The conduit 31 from the pump 30 connects with the valve 10 through the fluid inlet port 81 and is adapted to deliver hydraulic fluid thereto. The fluid outlet port 82 accommodates connection of a control line conduit 84 which leads to the fluid actuator for the DHSV. The bleed port 83 accommodates connection of a conduit 85 which communicates with the hydraulic fluid reservoir 35.

To insure fluid-tight integrity for the valve 10, peripheral seals 85, 86, 87 and 88 are provided for the closure member 46, piston 63, the transverse divider 53, and piston 73, respectively, for establishing fluid-tight seals between these members and the cylindrical wall of the axial bore 43. In addition, annular seals 89 and 90 are provided in the central opening in the divider 53 and in the bore through the second plunger element 71, respectively, for sealing against the piston rod 62 of the first plunger element 61.

A portion of the piston rod 72 of the second plunger element 71 which is received in the axial bore 45 is formed with a reduced diameter portion which with the cylindrical wall of bore 45 forms an annular chamber 91 about the piston rod 72. This annular chamber is disposed adjacent and in communication with the fluid inlet port 81 when the second plunger element 71 is in its first operating position as shown in FIG. 1. The annular chamber 91 is also of such longitudinal axial dimension, that for the second operating position of the plunger element 71 as shown in FIG. 2, it is in communication with both the fluid inlet port 81 and the fluid outlet port 82.

For further sealing between the second plunger element 71 and the valve body, piston rod 72 is also provided with annular seals 93, 94, respectively, at locations adjacent each end of the reduced diameter portion of the piston rod 72 which defines the annular chamber 91. In addition, the blocking portion 64 of the piston rod 62 is provided with a pair of longitudinally spaced annular seals 95, 96 for sealing with the bore wall of valve section 42. As shown in FIG. 1, wherein the valve plunger elements 61, 71 are in their first operating positions, it will be seen that the seals 95, 96 straddle the fluid outlet port 82 such that the seal 95 is interposed between the fluid inlet 81 and fluid outlet 82, and the seal 96 is interposed between the fluid outlet 82 and the bleed port 83.

It will therefore be seen that when there is no pilot pressure delivered by the safety system to the block valve 10, there is no fluid pressure acting against the pistons 63 and 73 as would overcome the biasing forces exerted by the springs 66 and 75. Accordingly, the first and second plunger elements 61, 71 are disposed in their first operating positions as illustrated in FIG. 1. In this condition, all fluid communication between the fluid inlet 81, the fluid outlet 82, and the bleed port 83 is blocked.

However, when the relay valve 18 of the safety system is in its open condition, as by manual setting thereof or when it is so maintained by fluid pressure delivered thereto from the flowline sensors, the pilot supply 12 delivers a pilot pressure through the conduits 20 and 21 to the block valve 10. The pilot pressure acts simultaneously on the pistons 63 and 73 to drive them to their second operating positions as shown in FIG. 2. In this condition, hydraulic fluid under pressure passes from the fluid inlet 81 through the annular chamber 91 and the fluid outlet 82 to the DHSV.

It is to be understood that the fluid delay circuit comprised of a check valve 98 and a restricted orifice 99 installed in parallel conduit branches **21*a*, 21*b*, respectively, does not delay the transmission of fluid in the direction from conduit 20 to the pilot port 49. The check valve 98** is installed to block flow in the reverse direction.

Figure 3:
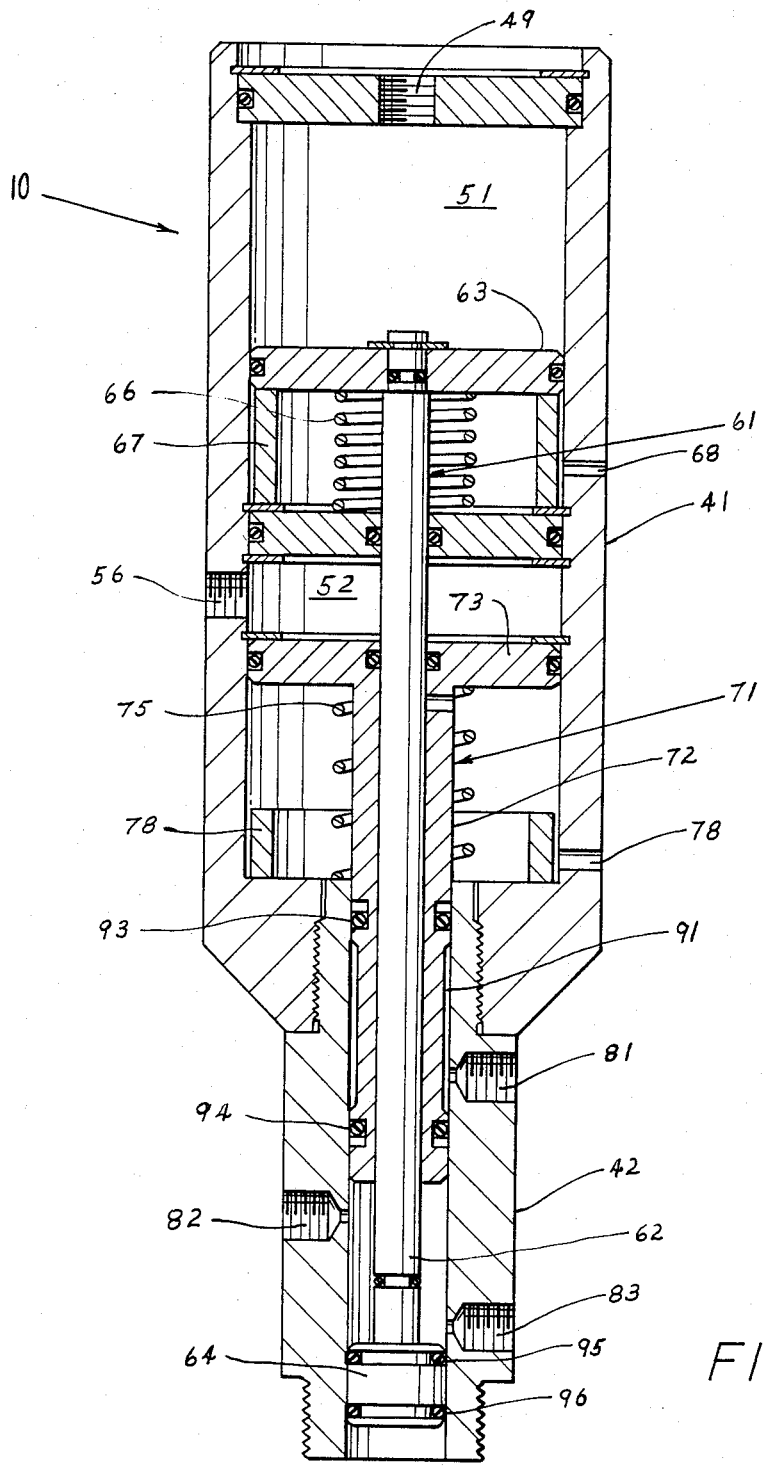
FIG. 3 is a sectional view similar to FIG. 2 showing the block valve of the invention in an intermediate operational condition wherein the inlet port of the valve is blocked from fluid communication with the outlet port, but the outlet port is in temporary fluid communication with the bleed port of the valve.

When it is desired to close the DHSV, the pilot supply to the block valve 10 is "cut-off" as by closure of the relay valve 18 or the ESD valve 16. The relay valve 18, of course, will also close in the event of an unsafe out of range pressure condition as sensed by the flowline pressure sensors or in the event of a failure or "break" in the pilot supply system. The cutting off of pilot pressure by the relay 18 from the piston chamber 52 and the piston 73, permits the fluid pressure to bleed rapidly from the chamber 52 as through a vent in the relay 18, and allow the spring 75 to return the second plunger element 71 to its raised first operating position as shown in FIG. 3.

However, the first plunger element 61 is not immediately returned to its first operating position on closure of the relay 18, since fluid pressure from the piston chamber 51 must bleed slowly through the conduit 21 and the fluid time delay circuit due to the presence of the flow restrictor orifice 99 in the conduit **21*b* and the check valve 98 in the conduit 21*a*. The first plunger element 61 remains in its second operating position until the pilot pressure has sufficiently bled from the piston chamber 51 to allow the spring 66 to return the plunger element 61 to its first operating position. Consequently, as shown in FIG. 3, the path between the fluid outlet 82 and the bleed port 83 is opened for the limited time that the second plunger element 71 is in its first operating position while the first plunger element 61 is in its second operating position. At the same time the path between the fluid outlet 82 and fluid inlet 81 is blocked by the seal 94**.

Bleeding of fluid pressure from the actuator for the DHSV to the reservoir 35 thereby occurs during this limited time as determined by the time delay imposed by the fluid delay circuit elements 98, 99. The delay time is selected to assure that fluid pressure has completely bled from the actuator so that the DHSV is completely closed prior to the blocking of the flow path between the fluid outlet 82 and the bleed port 83 by the blocking portion 64 of the first plunger element 61 when in its first operating position.

It will therefore be seen that the block valve of this invention provides a positive block in the control line 84 from the DHSV. In the event of a packing failure or other failure of the DHSV, well pressure moving up the control line 84 would be transmitted no further than the blocking portion 64, thus protecting the safety system, the reservoir and adjacent environs from possible catastrophic consequences. In addition, its compact and relatively simple construction minimizes the total number of conduits and other components of the safety system with attendant advantages of enchanced reliability and economies in manufacture.

It is also to be understood that the foregoing description of a preferred embodiment of the invention has been presented for purposes of illustration and description and is not intended to limit the invention to the precise form disclosed. While it is preferred that the pilot supply be a pneumatic system and that hydraulic pressure be supplied to the DHSV, the valve could readily be adapted to handle either pneumatic or hydraulic systems. The block valve 10 is shown mounted atop the reservoir with its bore 45 in communication therewith but this is only a preferred arrangement and is not essential. The valve 10 might also be efficiently employed with safety systems which differ slightly from that illustrated. It is to be appreciated therefore, that changes in details of the illustrated construction may be made by those skilled in the art, within the scope of the appended claims, without departing from the spirit of the invention.

What is claimed is:

1. A valve device adapted for controlling distribution of fluid between a hydraulic fluid supply, a fluid actuator device and a reservoir, said device comprising:

an elongate valve body having an axial bore extending therethrough including a reduced diameter bore section and an enlargement thereof which provides an enlarged diameter bore section;

transverse wall means dividing said enlarged diameter bore section into longitudinally spaced first and second piston chambers, said valve body being provided with an inlet port, an outlet port and a bleed port which communicate with the reduced diameter section of the axial bore at longitudinally spaced locations;

a first plunger element slidably mounted in said axial bore for movement between first and second operating positions, said first plunger element including an elongate rod having an enlarged diameter blocking portion slidably disposed within the reduced diameter bore section and a first piston affixed to said rod and disposed within said first piston chamber;

a second plunger element comprising an elongate rod having a reduced external diameter portion cooperating with the wall of said axial bore to define an annular chamber therewith, a second piston affixed to the rod of the second plunger element and an elongate bore extending axially through the rod and piston portions of said second plunger element, said second plunger element being disposed intermediate the first piston and the blocking portion of the rod of the first plunger element in sleeved relationship to the rod portion of the first plunger element, said second plunger element being adapted for sliding movement on the rod portion of the first plunger element between first and second operating positions;

first spring means for urging the first plunger element and said first piston towards its first operating position;

second spring means for urging the second plunger element and said second piston in a direction outwardly of said reduced diameter bore section towards its first operating position, said first and second piston chambers being each provided with fluid inlet port means whereby a pressurized pilot fluid delivered to said piston chambers through said fluid inlet port means will simultaneously urge the first and second plunger elements to their respective second operating positions, each said plunger element being moved by its associated spring means to the first operating position when pressurized pilot fluid is removed from the piston chambers, said enlarged diameter blocking portion of the first plunger element being positioned intermediate the inlet and bleed ports of the valve body and adjacent said outlet port when the first plunger element is in its first operating position to block fluid communication between the respective inlet, outlet and bleed ports of the valve body;

first seal means mounted about the periphery of the rod of the second plunger element at a location intermediate the second piston and said annular chamber for blocking fluid communication between said inlet port and the second piston chamber for all operating positions of the second plunger element; and second seal means mounted about the periphery of the rod portion of the second plunger element and located intermediate the blocking portion of the first plunger element and said annular chamber, said second seal means being disposed intermediate the inlet and outlet ports when the second plunger element is in its first operating position for blocking fluid communication between the inlet port and the outlet port of the valve, said second seal means being disposed intermediate the outlet port and the bleed port when said second plunger element is in the second operating position for blocking communication therebetween and said annular chamber being disposed adjacent both said inlet and outlet ports in the second operating position of the second plunger element for establishing communication between the inlet and outlet ports when the second plunger element is in its second operating position, said blocking portion and seal means being simultaneously carried with said plunger elements on moving to said second operating position.

2. A valve device adapted for controlling distribution of fluid in a fluid control system, said device comprising:

an elongate valve body having an axial bore extending therethrough including a reduced diameter bore section and an enlargement thereof which provides an enlarged diameter bore section;

transverse wall means dividing said enlarged diameter bore section into longitudinally spaced first and second piston chambers, said valve body being provided with an inlet port, an outlet port and a bleed port which communicate with the reduced diameter section of the axial bore at longitudinally spaced locations;

a first plunger element slidably mounted in said axial bore for movement between first and second operating positions, said first plunger element including an elongate rod having an enlarged diameter blocking portion slidably disposed within the reduced diameter bore section and a first piston affixed to said rod and disposed within said first piston chamber;

a second plunger element comprising an elongate rod having a reduced external diameter portion cooperating with the wall of said axial bore to define an annular chamber therewith, a second piston affixed to the rod of the second plunger element and an elongate bore extending axially through the rod and piston portions of said second plunger valve element, said second plunger element being disposed intermediate the first piston and the blocking portion of the rod of the first plunger element in sleeved relationship to the rod portion of the first plunger element, said second plunger element being adapted for sliding movement on the rod portion of the first plunger element between first and second operating positions;

first spring means for urging the first plunger element and said first piston towards its first operating position;

second spring means for urging the second plunger element and said second piston in a direction outwardly of said reduced diameter bore section towards its first operating position, said first and second piston chambers being each provided with fluid inlet port means whereby a pressurized pilot fluid delivered to said piston chambers through said fluid inlet port means will simultaneously urge the first and second plunger elements to their respective second operating positions, each said plunger element being moved by its associated spring means to the first operating position when pressurized pilot fluid is removed from the piston chamber;

first seal means mounted about the periphery of the rod portion of the second valve plunger element to block fluid communication between said fluid inlet port and the second piston chamber for both the first and second operating positions of the second valve plunger element;

second and third seal means on said first plunger element positioned for blocking fluid communication between said respective inlet, outlet and bleed ports when the first plunger element is in its first operating position but being removed from blocking position between any of said inlet, outlet or bleed ports when the first plunger element is in its second operating position; and four seal means on said second plunger element positioned for blocking fluid communication between the inlet port and the outlet port when the second plunger element is in its first operating position but being moved to a position between the outlet port and the bleed port for blocking fluid communication therebetween when the second plunger element is in its second operating position, said blocking portion and said seal means being simultaneously carried with seal plunger elements to said second operating position on admission of pilot fluid to said chambers, said annular chamber communicating with both said inlet and outlet ports in the second operating position of the second plunger element for establishing communication between the inlet and outlet ports when the second plunger element is in its second operating position.

3. A valve device as described in claim 2 wherein said inlet port is adapted for connection with a pressurized fluid supply, said outlet port is adapted for connection with a fluid actuator device, said bleed port is adapted for connection with a fluid reservoir, and said fluid inlet port means are adapted for connection to a source of pressurized pilot fluid for simultaneously driving the plunger elements with said seal means to their second operating positions upon pilot fluid admission therethrough, said fluid inlet port means including means for delaying the bleeding of pressurized pilot fluid from the first piston chamber with respect to the bleeding of pressurized pilot fluid from said second piston chamber upon interruption of pilot fluid pressure to said piston and bleeding of pilot fluid therefrom, said first plunger element thereby being delayed in returning to its first operating position with respect to the return of the second plunger element to its first operating position and permitting the bleeding of pressurized supply fluid from the actuator device to the fluid reservoir for a predetermined period of time prior to the return of the first plunger element to its first operating positon.

* * * * *

UNITED STATES PATENT AND TRADEMARK OFFICE

CERTIFICATE OF CORRECTION

PATENT NO. : 4,530,377

DATED : July 23, 1985

INVENTOR(S) : Clifford M. Peters

It is certified that error appears in the above-identified patent and that said Letters Patent is hereby corrected as shown below:

Column 9, line 41, after "from" insert -- a --.

Column 10, line 3, change "four" to -- fourth --.

Signed and Sealed this

*Twenty-sixth* Day of *November 1985*

[SEAL]

*Attest:*

DONALD J. QUIGG

*Attesting Officer*

*Commissioner of Patents and Trademarks*